US006012905A

United States Patent [19]

Takashima et al.

[11] Patent Number: 6,012,905

[45] Date of Patent: Jan. 11, 2000

[54] SUCTION AND DISCHARGE VALVE MECHANISM FOR FLUID DISPLACEMENT APPARATUS

[75] Inventors: Mitsuhiro Takashima, Nitta-gun; Yujiro Morita, Honjo, both of Japan

[73] Assignee: Sanden Corporation, Gunma, Japan

[21] Appl. No.: 09/030,251

[22] Filed: Feb. 25, 1998

[30] Foreign Application Priority Data

Feb. 25, 1997 [JP] Japan ..... 9-040636

[51] Int. Cl.[7] ..... F04B 1/14; F04B 1/28; F04B 27/10

[52] U.S. Cl. ..... 417/222.1; 417/269

[58] Field of Search ..... 417/222.1, 222.2, 417/269, 270; 91/499

[56] References Cited

U.S. PATENT DOCUMENTS

| | | | |
|---|---|---|---|
| 4,776,259 | 10/1988 | Takai | 92/71 |
| 4,813,852 | 3/1989 | Ikeda et al. | 417/269 |
| 4,820,133 | 4/1989 | Steele et al. | 417/269 |
| 5,232,349 | 8/1993 | Kimura et al. | 417/269 |
| 5,236,312 | 8/1993 | Finn et al. | 417/269 |
| 5,429,482 | 7/1995 | Takenaka et al. | 417/269 |
| 5,533,871 | 7/1996 | Takenaka et al. | 417/269 |
| 5,556,260 | 9/1996 | Takenaka et al. | 417/269 |
| 5,556,261 | 9/1996 | Kimura et al. | 417/269 |
| 5,626,463 | 5/1997 | Kimura et al. | 417/269 |
| 5,645,405 | 7/1997 | Ota et al. | 417/269 |

FOREIGN PATENT DOCUMENTS

| | | |
|---|---|---|
| 2520059 | 7/1983 | France . |
| 321472 | 6/1920 | Germany . |
| 0533618 | 9/1932 | Germany . |
| 4415088 | 11/1994 | Germany . |
| 4446302 | 6/1995 | Germany . |
| 4119370 | 10/1992 | Japan . |
| 5126040 | 5/1993 | Japan . |
| 0581735 | 10/1946 | United Kingdom . |
| 9601946 | 1/1996 | WIPO . |

*Primary Examiner*—Willis R. Wolfe
*Attorney, Agent, or Firm*—Baker & Botts, L.L.P.

[57] ABSTRACT

A piston-type fluid displacement apparatus includes a housing enclosing a crank chamber, a suction chamber, and a discharge chamber. Discharge conduits are formed at a top dead center position of the piston. A control device includes valve members having suction apertures and discharge apertures for opening and closing the suction conduits and the discharge conduits. The control device further includes a driving mechanism joined to the valve members for driving the valve members to gradually open each of the suction conduits during the suction stage of the piston and to gradually close each of the discharge conduits during the discharge stage of the piston. Thus, the piston-type fluid displacement apparatus may prevent the valve assembly from stopping or sticking at the sliding contact surfaces of the suction and discharge holes to allow the pistons to reciprocate smoothly within each cylinder without reducing the compression efficiency. Further, the piston-type fluid displacement apparatus also improves the sealing performance between the valve assembly and the sliding contact surfaces of the suction and discharge holes.

14 Claims, 8 Drawing Sheets

SUCTION AND DISCHARGE VALVE MECHANISM FOR FLUID DISPLACEMENT APPARATUS

BACKGROUND OF THE INVENTION

1. Field of the Invention

The present invention relates to a suction and discharge valve mechanism for a fluid displacement apparatus. More particularly, it relates to a configuration of a suction and discharge valve mechanism for a reciprocating piston-type refrigerant compressor used in an automotive air conditioning system.

2. Description of the Related Art

Piston-type compressors, such as swash plate-type compressors and wobble-type compressors, are known in the art. For example, U.S. Pat. No. 4,776,259 to Takai describes an air conditioning device used for a vehicle employing a multi-cylinder, piston-type compressor with reciprocating pistons and a suction and discharge valve mechanism.

In the following description, the right side of each figure is referred to as a rear or rearward end, and the left side of each figure is referred to as a front or forward end. With reference to FIGS. 1 and 2, a wobble plate-type compressor is shown comprising a compressor housing 11 having a cylinder block 11*b* fixed at a rear end of compressor housing 11, and a front end plate 10 disposed on a front end opening of compressor housing 11. A cylinder head 18, defining a discharge chamber 20 and a suction chamber 19, is mounted on the rear end opening of compressor housing 11 behind a valve plate 18*a*.

A discharge valve assembly is mounted on a rear end surface of valve plate 18*a*. Valve plate 1 8*a* has a discharge hole 20*a* extending therethrough to allow communication between the compression chamber and discharge chamber 20. The discharge valve assembly comprises a discharge valve 22 and a valve retainer 21, which is secured to a rear end surface of valve plate 18*a* by bolt 23.

Referring to FIG. 2, valve retainer 21 limits the bending movement of discharge reed valve 22 in the direction in which the refrigerant gas exits a cylindrical bore 17 and enters discharge chamber 20 through discharge hole 20*a*. Discharge reed valve 22 has a modulus of elasticity which keeps discharge hole 20*a* closed until the pressure in cylindrical bore 17 reaches a predetermined value.

Compressor housing 11 defines a crank chamber 13 that is adjacent to cylinder block 11*b*. Cylinder block 11*b* is provided with a plurality of equi-angularly spaced cylindrical bores 17. A drive shaft 12 is rotatably supported at its rear end by cylinder block 11*b* through a bearing 12*b*, and at its front end by a front end plate 10 through a bearing 12*a*. A cam rotor 14 is fixedly mounted on drive shaft 12 by a pin (not shown) and rotatably supported relative to a rear end surface of front end plate 10 through a thrust bearing 12*c*. A wobble plate 15 is disposed on a reduced diameter portion 15*b* of cam rotor 14 that extends axially outward from the inclined cam surface of cam rotor 14. A thrust bearing 14*a* is interposed between wobble plate 15 and the inclined cam surface of cam rotor 14.

Wobble plate 15 is prevented from axial movement on reduced diameter portion 15*b* by restraining ring 15*c*. A reciprocating piston 16 is received in each of cylindrical bores 17. Each piston 16 is connected to wobble plate 15 through a piston rod 16*a*. A restraining means 15*a* comprises a slot formed in the peripheral surface of wobble plate 15 and slide plate 11 a mounted in the bottom portion of crank chamber 13 and extending axially thereof.

Discharge reed valve 22 strikes a rear end surface of valve plate 18*a* when it closes. This striking generates vibration and noise during the operation of the compressor. Vibration, caused by discharge reed valve 22 striking a rear end surface of valve plate 18*a*, is readily transmitted to compressor housing 11.

One proposed solution to overcome the above-mentioned disadvantages is described in Japanese Unexamined Utility Model Publication No. H4-119,370. That application describes a compressor wherein a valve mechanism includes circular plate members connected to the drive shaft. The rotation of the drive shaft and the circular plate members opens and closes the suction conduits and the discharge conduits.

Another proposed solution to overcome the above-mentioned disadvantages is described in Japanese Unexamined Patent Publication No. H5-126,040. The application discloses a compressor wherein a valve mechanism comprises a rotary valve or a piston, or a rod, in lieu of circular plate members. The valve mechanism opens and closes the suction conduit and the discharge conduit, respectively.

However, in the configuration of the valve mechanism comprising circular plate members and a rotary valve, the sliding contact surfaces do not move smoothly with respect to each other, and the sealing performance between the sliding contact surfaces is decreased. As a result, an manufacturer is required to carefully control the clearance of the sliding contact surfaces in assembling the compressor. Thus, this configuration is difficult to manufacture and expensive to assemble.

Further, in the configuration of the compressor comprising a piston or a rod, the valve mechanism acts to either fully open or fully close a suction conduit and a discharge conduit during a suction stage or a discharge stage of the compressor. The valve mechanism does not permit opening a fraction of an area of the suction conduit and the discharge conduit, i.e., a suction conduit is fully opened and a discharge conduits is fully closed when the compressor moves from the suction stage to the discharge stage. Thus, the suction conduit and discharge conduit are opened fully and closed fully without considering the reciprocating speed of the piston.

Generally, a piston within a cylinder reciprocates with speed reaching zero at the bottom dead center and top dead center positions, and with maximum speed at a position halfway between bottom dead center and top dead center. Thus, it is difficult for a piston to reciprocate smoothly within a cylinder because the replacement fluid sucked into and discharged from the cylinder has an inertia force. This results in a decrease in the compression efficiency.

SUMMARY OF THE INVENTION

It is an object of the present invention to provide a piston-type fluid displacement apparatus which prevents the valve assembly from sticking or stopping at the sliding contact surfaces of the suction and discharge holes.

It is another object of the present invention to provide a piston-type fluid displacement apparatus which increases or improves, or both, the sealing performance between the valve assembly and the sliding contact surfaces of the suction and discharge holes.

It is a further object of the present invention to provide a piston-type fluid displacement apparatus wherein a piston reciprocates smoothly within a cylinder.

According to the present invention, a piston-type fluid displacement apparatus comprises a housing enclosing a crank chamber, a suction chamber, and a discharge chamber. A plurality of cylinders are formed in the housing. A plurality of pistons, each of which is slidably disposed within one of the cylinders, reciprocate within the cylinders. A plurality of suction conduits are formed at the top dead center positions of the pistons. A plurality of discharge conduits also are formed at the top dead center positions of the pistons. A driving device is coupled to the pistons for driving the pistons, such that the rotary motion of the driving device is converted into a reciprocating motion of the pistons within the cylinders. A control device comprises a plurality of valve members having suction apertures and discharge apertures for opening and closing the suction conduits and the discharge conduits. The control device further comprises a driving mechanism joined to the valve members for driving each valve member to gradually open its respective suction conduit during the suction stage of its respective piston, and to gradually close its respective discharge conduit during the discharge stage of its respective piston.

Further objects, features, and advantages of this invention will be understood from the following detailed description of preferred embodiments with reference to the attached drawings.

DETAILED DESCRIPTION OF PREFERRED EMBODIMENTS

Figure 1:
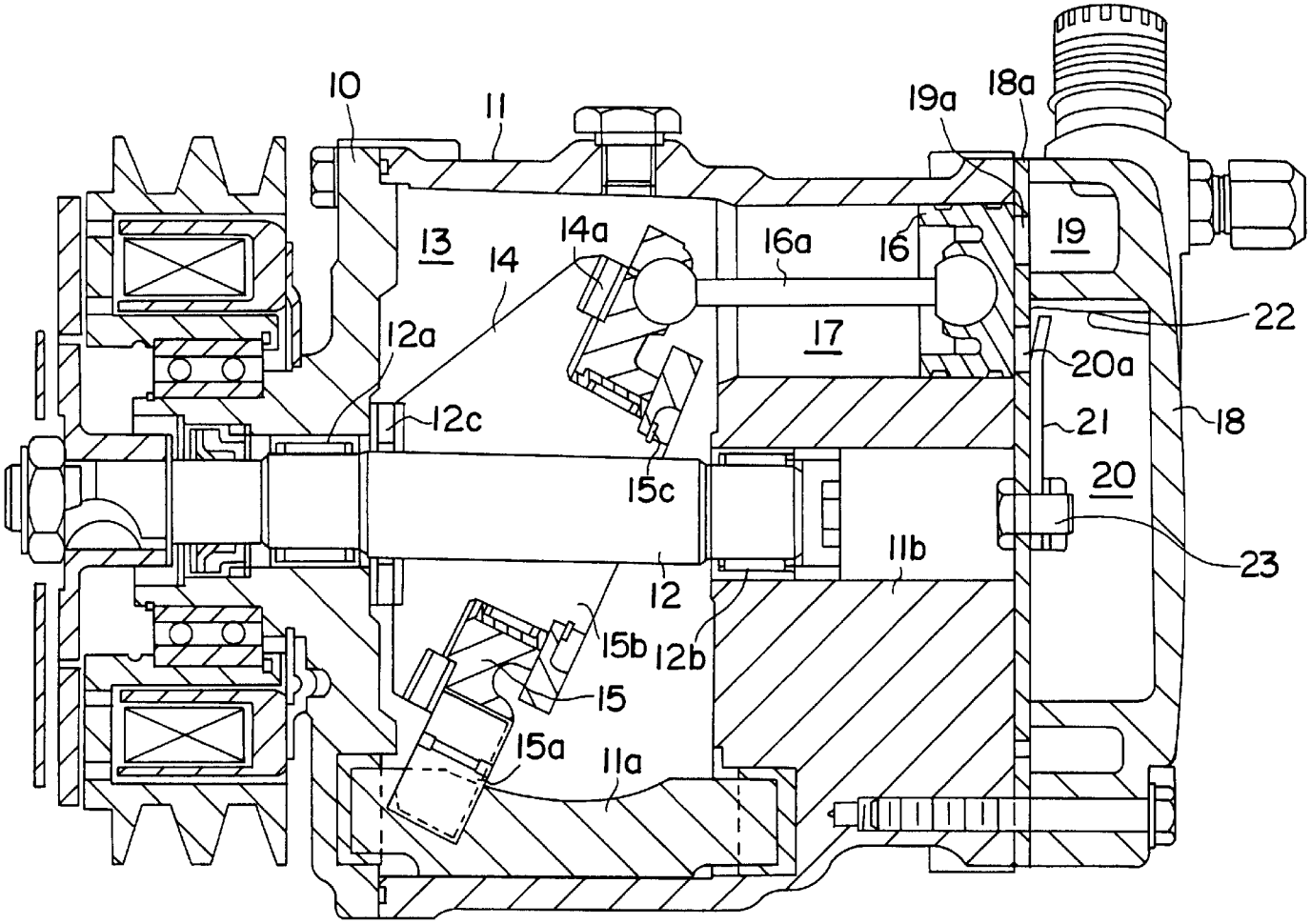
FIG. 1 PRIOR ART
FIG. 1 is a cross-sectional view of a wobble plate-type refrigerant compressor in accordance with a known embodiment.
Figure 2:
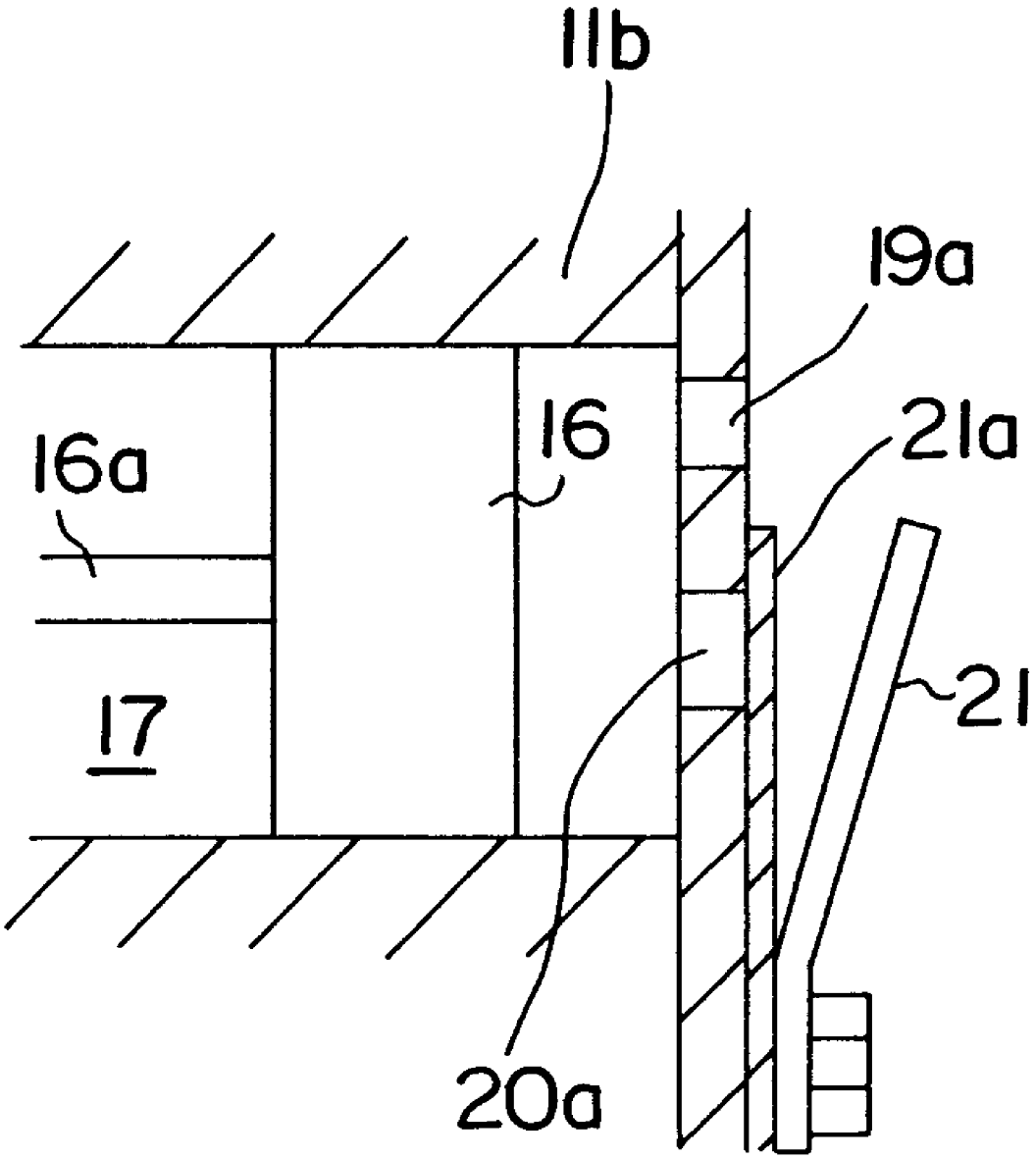
FIG. 2 PRIOR ART
FIG. 2 is an enlarged cross-sectional view of a suction and discharge valve mechanism assembly used in the wobble plate-type refrigerant compressor of FIG. 1.

The embodiments of the present invention are illustrated in FIGS. 3–8. In FIGS. 3–8, the same reference numerals are used to denote elements which correspond to elements depicted in FIGS. 1 and 2. A detailed explanation of these similar elements and their characteristics is provided above and, therefore, is here omitted.

Figure 3:
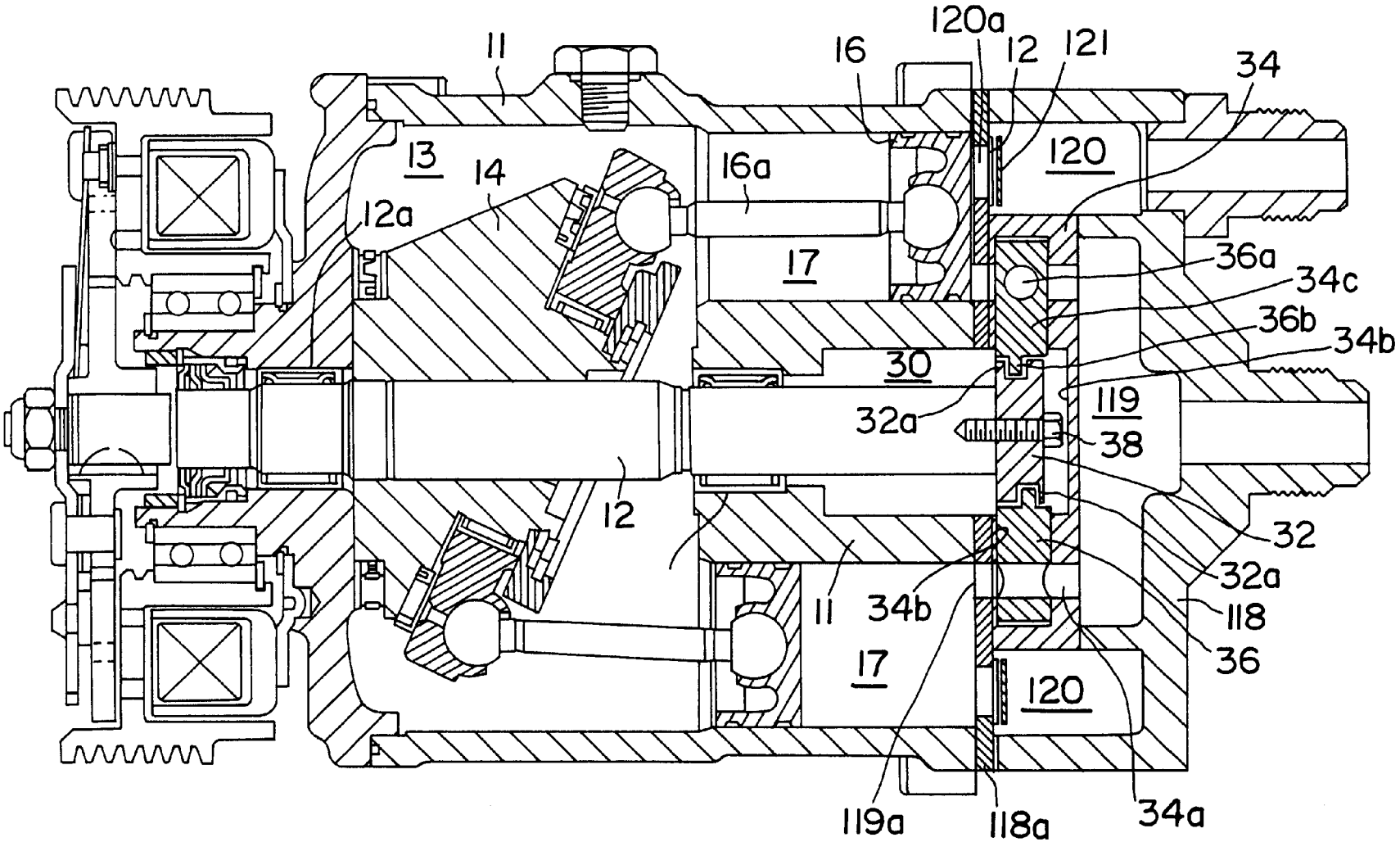
FIG. 3 is a cross-sectional view of a swash plate-type refrigerant compressor in accordance with a first embodiment of the present invention.

Referring to FIG. 3, a suction chamber 119 and a discharge chamber 120, defined by a cylinder head 118, are formed radially around drive shaft 12. A cylinder block 11 is provided with a cam chamber 30 at its center. Drive shaft 12 extends through a radial bearing 12*b* to cam chamber 30. A cam mechanism 32 is secured by a bolt 38 to a rear end of drive shaft 12 within cam chamber 30. Thus, cam mechanism 32 rotates with drive shaft 12 about a longitudinal axis of drive shaft 12. Cam mechanism 32 comprises a circular plate having a radial cam groove 32*a*. Cam groove 32*a* lies in a zigzag line axially, i.e., a part of cam groove 32*a* is axially offset at an interval angle of 180 degrees.

The compressor comprises a plurality of cylindrical bores 17 and a plurality of pistons 16, which are positioned around the axis of drive shaft 12 at 90 degree angular intervals. A plate member 34 is disposed between cam chamber 30 and suction chamber 119 in order to separate cam chamber 30 from suction chamber 119. Plate member 34 comprises a plurality of suction holes 34*a* corresponding to suction conduits 119*a*, a cylindrical recessed portion 34*b* formed at the center of plate member 34, and a plurality of cylindrical apertures 34*c* extending radially from cylindrical recessed portion 34*b* and each corresponding to a cylindrical bore 17. Each cylindrical aperture 34*c* is formed to be perpendicular to its corresponding suction hole 34*a*. A plurality of fluid valve members 36 are disposed in a plurality of cylindrical apertures 34*c* to cover a plurality of suction holes 34*a*. Fluid valve members 36 are in contact with the radial outer circumference of plate member 34. Each fluid valve member 36 has a cylindrical shape and comprises an opening 36*a* for placing suction conduit 119*a* and suction hole 34*a* in communication. Each of fluid valve members 36 also has a center axis perpendicular to the longitudinal axis of drive shaft 12 and is rotatably disposed in its respective cylindrical aperture 34*c*. Further, each of fluid valve members 36 comprises a drive pin member 36*b*, which is positioned to be eccentric with respect to the center axis of the fluid valve member 36. Thus, cam mechanism 32 causes fluid valve member 36 to counter-rotate around its axis.

In operation, drive shaft 12 of the above-mentioned compressor is driven by any suitable driving source, such as an automobile engine. Cam rotor 14 rotates together with drive shaft 12, such that wobble plate 15 is held against rotation with cam rotor 14 by a rotation restraining means (not shown). Nutation of wobble plate 15 causes the reciprocating action of each respective piston 16. Therefore, the evacuation and compression of a refrigerant gas is repeatedly performed in each cylinder 17.

Figure 4:
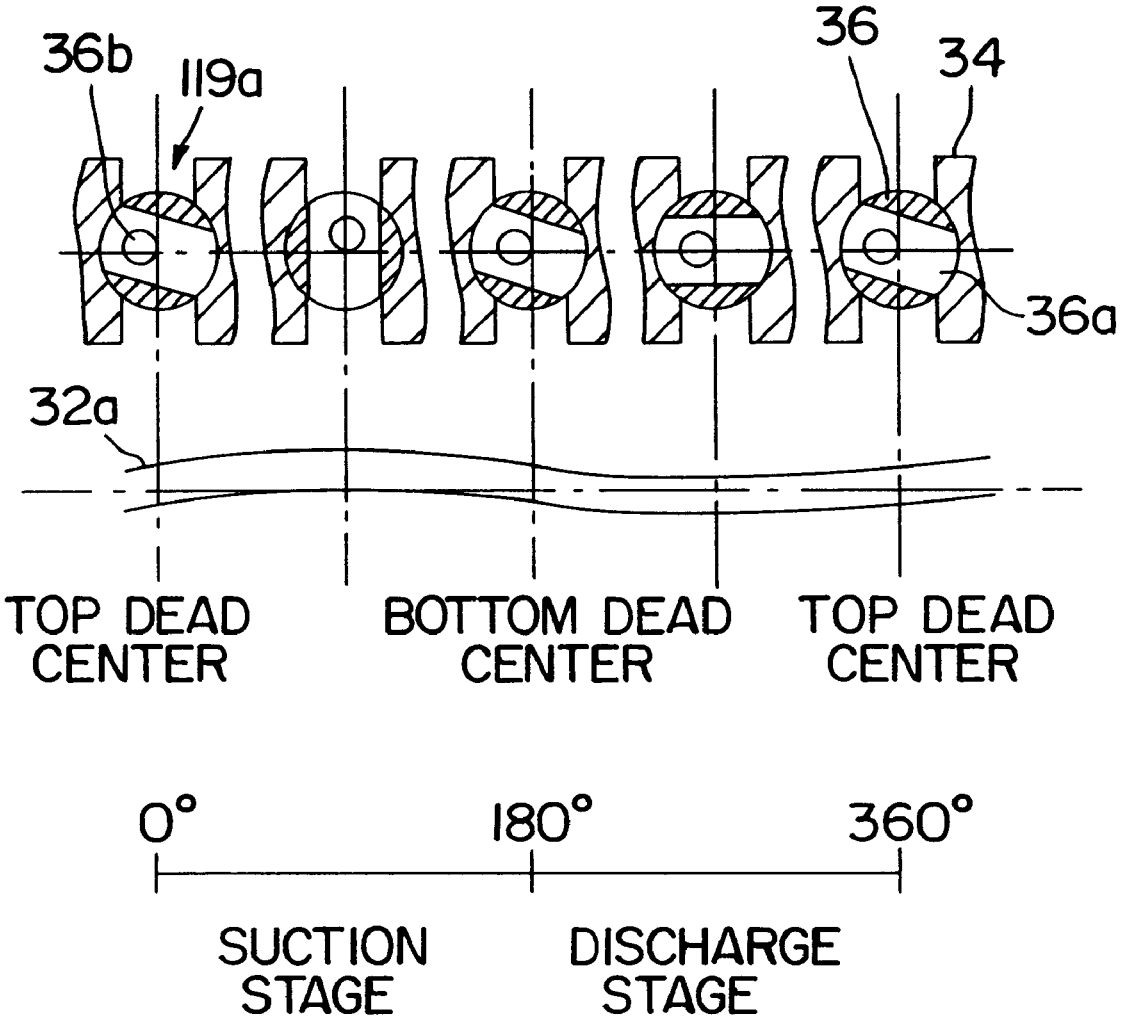
FIG. 4 is a schematic illustration of the cam mechanism of a control valve mechanism used in the swash plate-type refrigerant compressor in accordance with the first embodiment of the present invention.

FIG. 4 depicts a schematic view of one full cycle, wherein cam mechanism 32 and fluid valve member 36 operate from a suction stage to a discharge stage of piston 16. The top dead center and bottom dead center positions of piston 16 correspond to 0 degrees (360 degrees) and 180 degrees, respectively. The position of cam groove 32*a* of cam mechanism 32 also is depicted from the suction stage to the discharge stage.

During the suction stage (0 degrees–180 degrees), cam mechanism 32 causes fluid valve member 36 to counter-rotate, such that fluid valve member 36 begins to open suction conduit 119*a* at the top dead center position. Suction conduit 119*a* is opened fully at a piston position halfway between top dead center and bottom dead center. Suction conduit 119*a* again is closed at the bottom dead center position. Thus, cam mechanism 32 causes fluid valve member 36 to open gradually during the suction stage.

In contrast, during the discharge stage (180 degrees–360 degrees), cam mechanism 32 causes fluid valve member 36 to close suction conduit 119*a* throughout. Consequently, cam mechanism 32 substantially regulates how much of an area of suction conduit 119*a* is opened relative to the position of piston 16.

In this arrangement, fluid valve member 36 may move slidably on suction conduit 119*a* with a lower slide speed or shorter slide distance in comparison with the known art, because cam mechanism 32 permits fluid valve member 36 to rotate itself Therefore, cam mechanism 32 prevents the valve mechanism from stopping or sticking on sliding contact surfaces, while simultaneously improving sealing performance between the sliding contact surfaces.

Thus, piston 16 can reciprocate smoothly within cylindrical bore 17 because cam mechanism 32 causes fluid valve member 36 to open gradually during the suction stage, allowing fluid to be drawn smoothly into and discharged from the cylinder with little or no inertia force itself As a result, this arrangement increases or improves, or both, the compression efficiency in comparison with the known art.

A discharge valve member may be provided in lieu of fluid valve member 36, and a suction valve may be provided in lieu of discharge valve 122. In this arrangement, cam mechanism 32 causes the suction valve member to close the suction conduit throughout the suction stage. Cam mechanism 32 also causes the discharge valve member to open gradually the discharge conduit during the discharge stage to permit fluid valve member 36 to rotate. Alternatively, the compressor may be provided with not only fluid valve member 36, but also with a discharge valve member, in lieu of discharge valve 122 and retainer 121. Cam mechanism 32 may cause both the discharge valve member and the suction valve mechanism to rotate.

Figure 5:
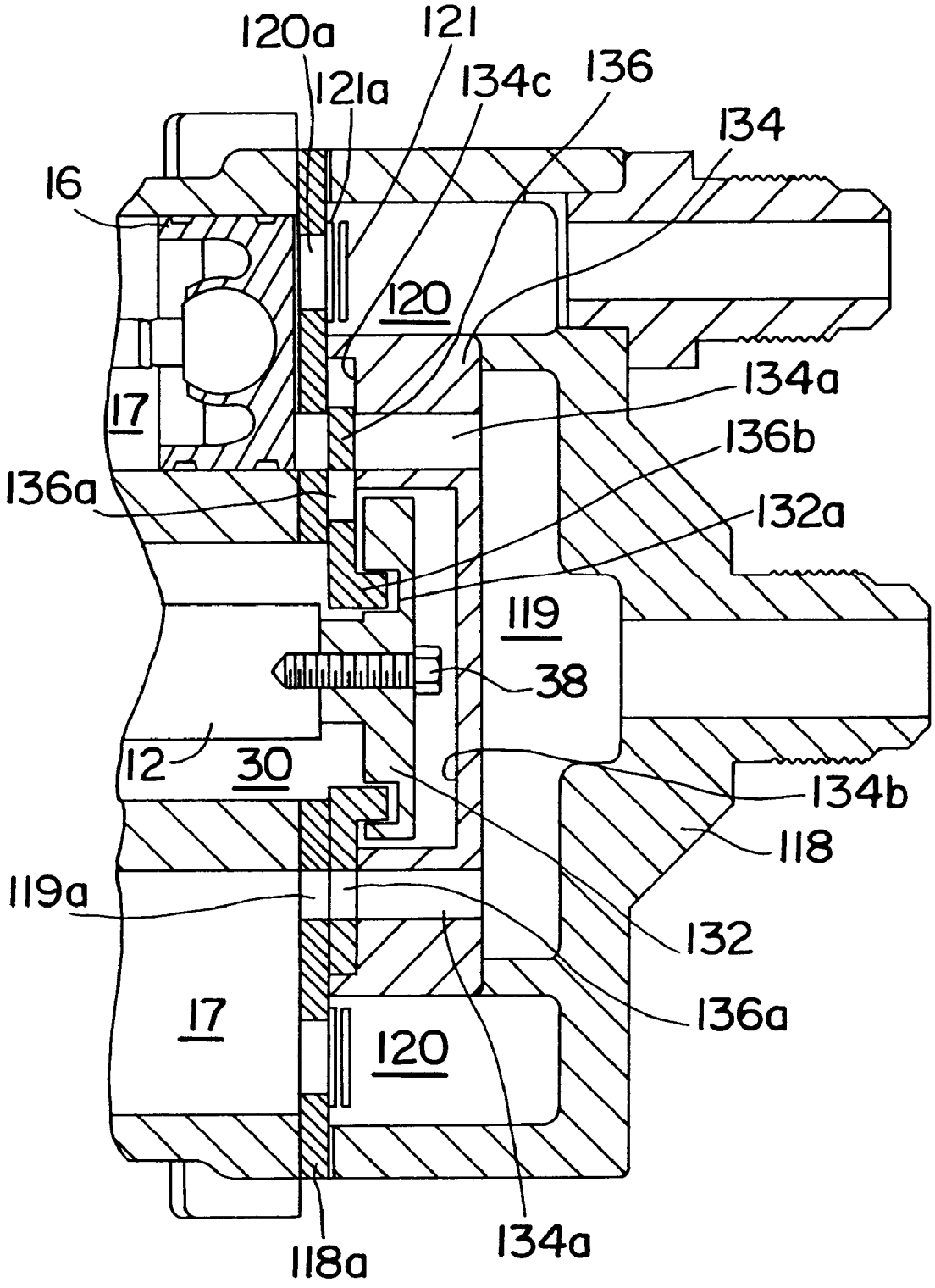
FIG. 5 is a cross-sectional view of a swash plate-type refrigerant compressor in accordance with a second embodiment of the present invention.
Figure 6:
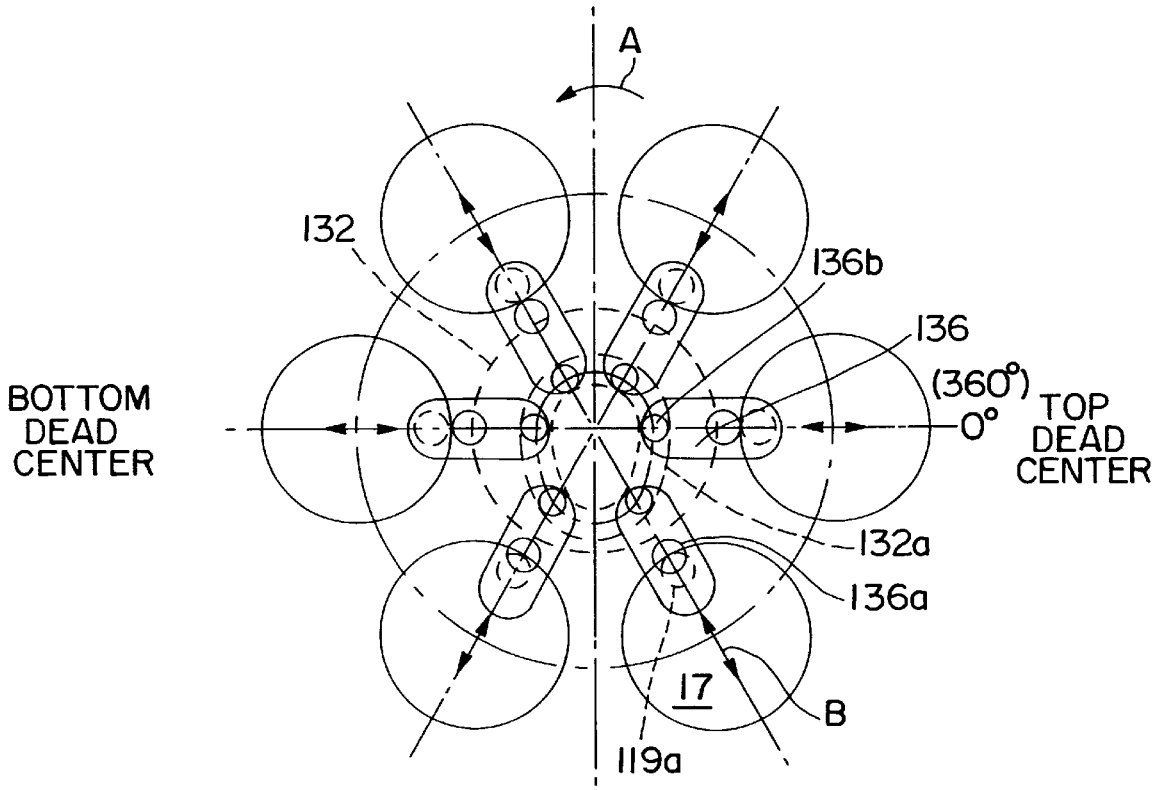
FIG. 6 is a schematic illustration of a control valve mechanism used in the swash plate-type refrigerant compressor in accordance with the second embodiment of the present invention.

A second embodiment of the present invention, applicable to a compressor having an arrangement different from the compressor of the first embodiment, is described in conjunction with FIGS. 5 and 6.

Referring to FIGS. 5 and 6, the compressor of the second embodiment comprises a plurality of fluid valve members 136 which are circular-shaped plates and are disposed between valve plate 118*a* and a plate member 134. Plate member 134 is disposed between cam chamber 30 and suction chamber 119 in order to separate cam chamber 30 from suction chamber 119. Plate member 134 comprises a plurality of suction holes 134*a* corresponding to a number of suction conduit 119*a*, a cylindrical recessed portion 134*b* formed at the center of plate member 134, and a plurality of rectangular grooves 134*c* radially extending from cylindrical recessed portion 134*b* and each corresponding to a cylindrical bore 17.

Each rectangular groove 134*c* is perpendicular to its corresponding suction hole 134*a*. A plurality of fluid valve members 136 are disposed slidably in a plurality of rectangular grooves 134*c* in order to cover a plurality of suction holes 134*a*. Fluid valve members 136 comprise an openings 136*a* for placing suction conduit 119*a* and suction hole 134*a* of plate member 134, in communication. Each fluid valve member 136 has a longitudinal axis perpendicular to the axis of drive shaft 12. Further, each of fluid valve members 136 includes a drive pin portion 136*b* extending perpendicularly from an end of the rear surface of the valve members. Cam mechanism 132 is secured to the rear axial end of drive shaft 12 by bolt 38 within cam chamber 30. Cam mechanism 132 comprises a substantially circular plate having a cam groove 132*a* formed thereon. am groove 132*a* may be an egg-shape groove. Each drive pin portion 136*b* of each fluid valve member 136 is disposed in cam groove 132*a* of cam mechanism 132, and slides in rectangular grooves 134*c* of plate member 134 relative its position in cam groove 132*a*. Thus, cam mechanism 132 causes suction valve member 136 to undergo reciprocating action in rectangular grooves 134*c* of plate member 134.

Referring to FIG. 6, a line which crosses the center of drive shaft 12 horizontally is defined as border line. The lower side and the upper side of the line represent a suction stage and a discharge stage, respectively. When drive shaft 12 and cam mechanism 132 rotate in a counterclockwise direction, as shown by arrow A, the cylinder which is positioned at 3 o'clock corresponds to a top dead center position of a piston. The cylinder positioned at 9 o'clock corresponds to a bottom dead center position of a piston.

During the suction stage of piston 16 (0 degrees–180 degrees), cam mechanism 132 causes fluid valve member 136 to move radially outward, in the direction shown by arrow B, such that fluid valve member 136 begins to open suction conduit 119*a* at the top dead center position. Suction conduit 119*a* is opened fully at a position halfway between top dead center and bottom dead center. Thereafter, cam mechanism 132 causes fluid valve member 136 to move radially inward, in the direction shown by arrow B, such that the suction conduit is closed at the bottom dead center position of piston 16. Thus, cam mechanism 132 causes fluid valve member 136 to open gradually during the suction stage of piston 16.

In contrast, cam mechanism 132 causes fluid valve member 136 to close suction conduit 119*a* throughout the discharge stage of piston 16 (180 degrees–360 degrees). Consequently, cam mechanism 132 substantially regulates how much of the area of suction conduit 119*a* is opened relative to the position of piston 16.

A discharge valve member may be provided in lieu of fluid valve member 136, and a suction valve may be provided in lieu of discharge valve 121*a*. In this arrangement, cam mechanism 132 causes the suction valve member to close the suction conduit throughout the suction stage of piston 16. Cam mechanism 132 also causes the discharge valve member gradually to open a discharge conduit in the discharge stage of piston 16 in order to permit fluid valve member 136 to slide within rectangular groove 134*c* of plate member 134.

The advantages obtained by the first preferred embodiment are also substantially realized by the second preferred embodiment.

Figure 7:
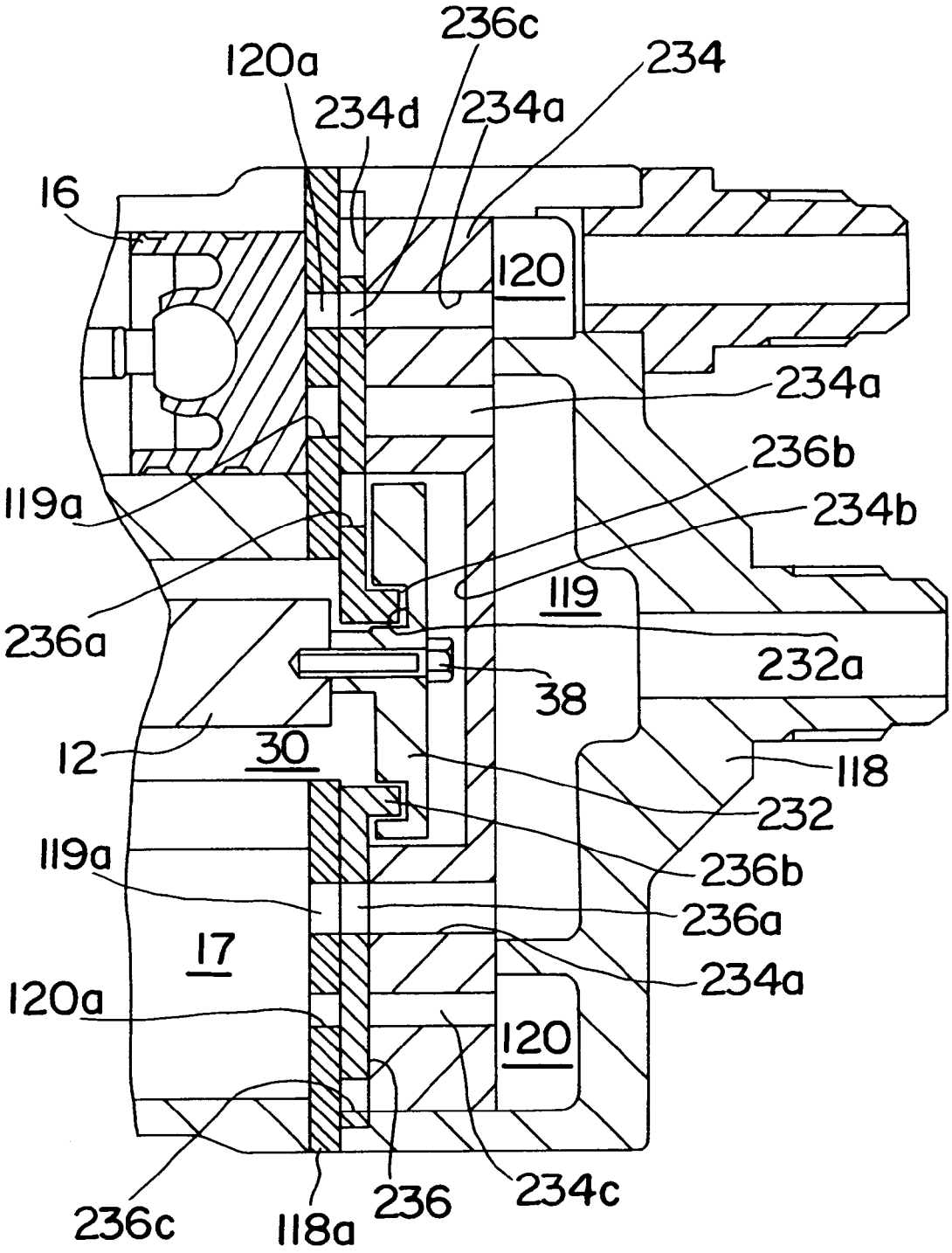
FIG. 7 is a cross-sectional view of a swash plate-type refrigerant compressor in accordance with a third embodiment of the present invention.
Figure 8:
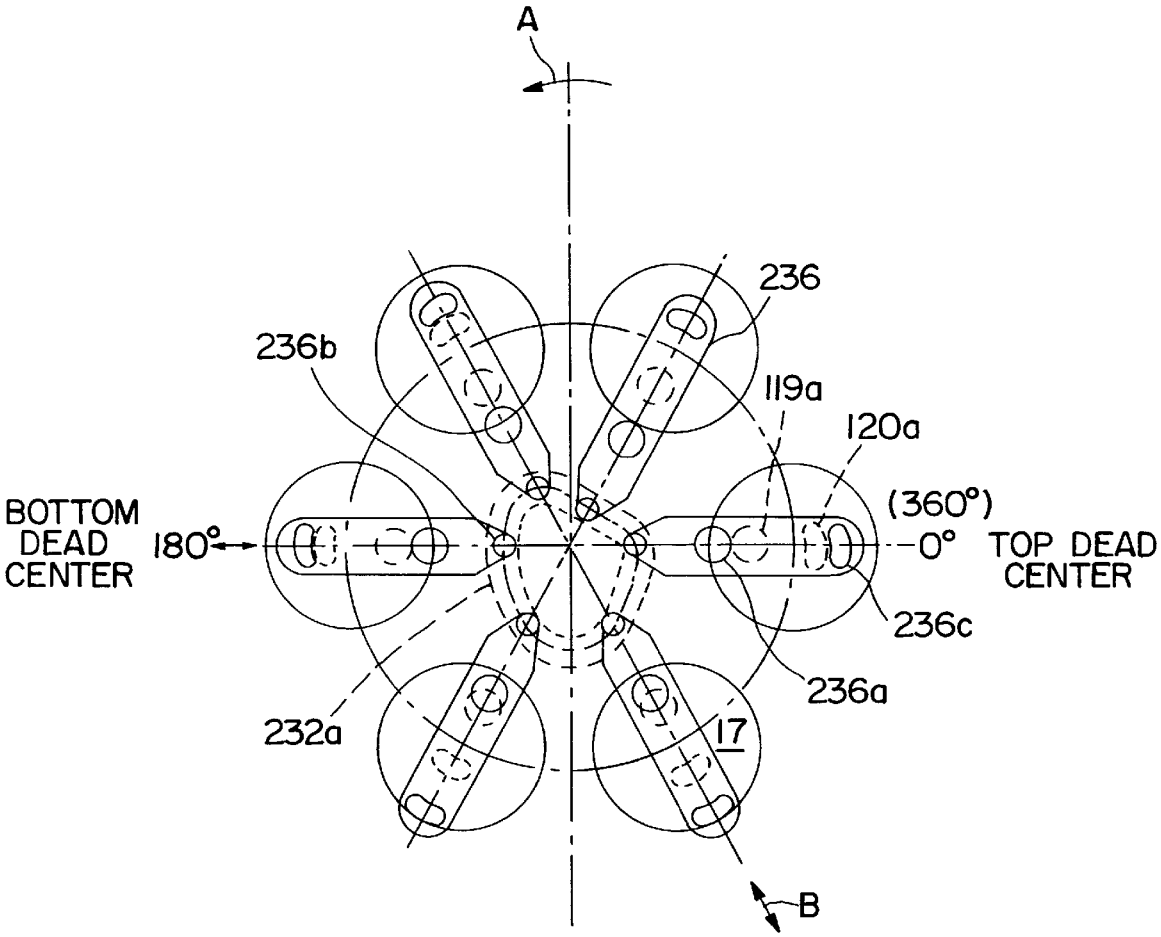
FIG. 8 is a schematic illustration of a control valve mechanism used in the swash plate-type refrigerant compressor in accordance with the third embodiment of the present invention.

A third embodiment of the present invention applicable to a compressor having an arrangement different from the compressor of the first embodiment is described in conjunction with FIGS. 7 and 8.

Referring to FIG. 7, the compressor of the third preferred embodiment includes a plurality of fluid valve members 236. Fluid valve members 236 are elliptically-shaped plates and are disposed between valve plate 118*a* and a plate member 234. Plate member 234 is disposed between cam chamber 30 and suction chamber 119 in order to separate cam chamber 30 from suction chamber 119. Plate member 234 includes a plurality of suction holes 234*a* therein corresponding to suction conduits 119*a*, a cylindrical recessed portion 234*b* formed at the center of plate member 234, and a plurality of discharge holes 234*c* formed radially outside of suction holes 234*a*. Discharge holes 234*c* correspond to a plurality of discharge conduits 120*a*. A plurality of rectangular grooves 234*d* are formed on an axial end of plate member 234 and are perpendicular to suction holes 234*a* and discharge holes 234*c*.

Fluid valve members 236 are slidably disposed in rectangular grooves 234*d* in order to cover suction holes 234*a* and discharge holes 234*c*. Each fluid valve member 236 includes an opening 236*a* formed therein for placing suction conduits 119*a* and suction holes 234*a* in communication. Discharge openings 236*a* also place discharge conduits 120*a* and discharge holes 234*c* in communication.

Further, each fluid valve member 236 includes a drive pin portion 236*b* extending axially from an edge of the rear surface. Cam mechanism 232 is secured by bolt 38 to a rear axial end of drive shaft 12 within cam chamber 30. Cam mechanism 232 comprises a substantially circular plate having a cam groove 232*a*. Cam groove 232*a* may be an egg-shape groove formed on a axial front end surface of cam mechanism 232. Each drive pin portion 236*b* of each fluid valve member 236 is disposed in cam groove 232*a* of cam mechanism 232 in order to slide in rectangular grooves 234*d* of plate member 234 relative to the rotation of cam groove 232*a*.

Thus, cam mechanism 232 causes fluid valve member 236 to undergo reciprocating action in rectangular grooves 234*d* of plate member 234.

Referring to FIG. 8, a line which crosses the center of drive shaft 12 horizontally defines a border line. The lower side and the upper side of the line represent a suction stage and a discharge stage of piston 16, respectively. When drive shaft 12 and cam mechanism 232 rotate in a counterclockwise direction, as shown by arrow A, the cylinder positioned at 3 o'clock corresponds to the top dead center position of a piston. The cylinder positioned at 9 o'clock corresponds to the bottom dead center position of a piston.

During the suction stage of piston 16 (0 degrees–180 degrees), cam mechanism 232 causes fluid valve member 236 to move radially outward, in the direction shown by arrow B, such that fluid valve member 236 begins to open suction conduit 119*a* at the top dead center position of piston 16. Suction conduit 119*a* is opened fully at a position halfway between top dead center and bottom dead center. Thereafter, cam mechanism 232 causes fluid valve member 236 to move radially inward, in the direction shown by arrow B, in order to fully close suction conduit 119*a* at the bottom dead center position of piston 16. Thus, cam mechanism 232 causes fluid valve member 236 to close discharge conduit 120*a* throughout the suction stage.

On the other hand, during the discharge stage of piston 16 (180 degrees–360 degrees), cam mechanism 232 causes fluid valve member 236 to move gradually inward, in the direction shown by arrow B, such that fluid valve member 236 begins to open discharge conduit 119*a* at the bottom dead center position of piston 16. Discharge conduit 119*a* is fully opened at a position halfway between top dead center and bottom dead center of piston 16. Thereafter, cam mechanism 232 causes fluid valve member 236 to move radially outward, in the direction shown by arrow B, in order to close fully at the top dead center position of piston 16. Thus, cam mechanism 232 causes fluid valve member 236 to close suction conduit 119*a* throughout the discharge stage.

Consequently, cam mechanism 232 allows fluid valve member 236 to under reciprocating action, such that fluid valve member 236 opens suction conduit 119*a* gradually in the suction stage of piston 16 and closes discharge conduit 120*a* gradually in the discharge stage of piston 16.

Substantially the same advantages as those in the first and second preferred embodiments are also realized by the third preferred embodiment.

Moreover, in the third preferred embodiment, cam mechanism 232 causes fluid valve member 236 to gradually open suction conduit 119*a* during the suction stage of piston 16, in addition to closing discharge conduit 120*a* throughout during the discharge stage of piston 16. Thus, a fluid can be smoothly suctioned from suction chamber 119 and discharged to discharge chamber 120 without having inertia force. Therefore, cam mechanism 132 suitably regulates the open area of suction conduit 119*a* relative to the position of piston 16, and piston 16 can reciprocate smoothly within cylindrical bore 17. As a result, this arrangement may increase or improve, or both, the compression efficiency.

Although the present invention has been described in connection with preferred embodiments, the invention is not limited thereto. Specifically, this invention may employ a link mechanism as a control device for the fluid valve member. Further, this invention may be realized by combining an inspection device within the driving device, to inspect the position of the piston in the suction stage and the discharge stage and regulate the opening area of the suction valve and the discharge valve.

In addition, while the preferred embodiments illustrate the invention in a swash plate-type compressor, this invention is not restricted to swash or wobble plate-type refrigerant compressors, but may be employed in other piston-type compressors or piston-type fluid displacement apparatus. Accordingly, the embodiments and features disclosed herein are provided by way of example only. It will be understood by those of ordinary skill in the art that variations and modifications may be made within the scope of this invention as defined by the following claims.

We claim:

1. A piston-type fluid displacement apparatus comprising:

a housing enclosing a crank chamber, a suction chamber, and a discharge chamber;

a plurality of cylinders formed inside said housing;

a plurality of pistons, wherein each piston is slidably disposed within one of said cylinders such that said piston reciprocates within said cylinder;

a plurality of suction conduits formed at a top dead center position of said piston;

a plurality of discharge conduits formed at said top dead center position of said piston;

a drive shaft rotatably supported in said housing, wherein said drive shaft is coupled to said pistons for driving said pistons, such that a rotary motion of said drive shaft is converted into a reciprocating motion of said pistons within said cylinders; and control means comprising a plurality of valve members, each valve member having a suction aperture and a discharge aperture for opening and closing said suction conduit and said discharge conduit, wherein said control means further comprises a driving mechanism connected to said valve members for driving said valve members to gradually open each of said suction conduits during a suction stage of said piston.

2. The piston-type fluid displacement apparatus of claim 1, wherein said control means controls said driving mechanism and said valve member, such that each of said suction conduits begins to open at said top dead center position of said piston, is opened fully at a position halfway between said top dead center position and said bottom dead center position of said piston, and is closed fully at a bottom dead center position of said piston.

3. A piston-type fluid displacement apparatus comprising:

a housing enclosing a crank chamber, a suction chamber, and a discharge chamber;

a plurality of cylinders formed inside said housing;

a plurality of pistons, wherein each piston is slidably disposed within one of said cylinder such that said piston reciprocates within said cylinder;

a plurality of suction conduits formed at a top dead center position of said piston;

a plurality of discharge conduits formed at said top dead center position of said piston;

a drive shaft rotatably supported in said housing, wherein said drive shaft is coupled to said pistons for driving said pistons, such that a rotary motion of said drive shaft is converted into a reciprocating motion of said pistons within said cylinders; and control means comprising a plurality of valve members, each valve member having a suction aperture and a discharge aperture for opening and closing said suction conduits and said discharge conduits, wherein said control means further comprises a driving mechanism connected to said valve members for driving said valve members to gradually open each of said discharge conduits during a discharge stage of said piston.

4. The piston-type fluid displacement apparatus of claim 3, wherein said control means controls said driving mechanism and said valve members such that each of said discharge conduits begins to open at a bottom dead center of position of said piston, is opened fully at a position halfway between said top dead center position and said bottom dead center position of said piston, and is closed fully at said top dead center position of said piston.

5. A piston-type fluid displacement apparatus comprising:

a housing enclosing a crank chamber, a suction chamber, and a discharge chamber;

a plurality of cylinders formed inside said housing;

a plurality of pistons, wherein each piston is slidably disposed within one of said cylinders, such that said piston reciprocates within said cylinder;

a plurality of suction conduits formed at a top dead center position of said piston;

a plurality of discharge conduits formed at said top dead center position of said piston;

a drive shaft rotatably supported in said housing, wherein said drive shaft is coupled to said pistons for driving said pistons, such that a rotary motion of said drive shaft is converted into a reciprocating motion of said pistons within said cylinders; and a control means comprising a plurality of valve members having a suction aperture and a discharge aperture for opening and closing said suction conduits and said discharge conduits, said control means further comprising a driving mechanism joined to said valve members for driving said valve members to gradually open each of said suction conduits during a suction stage of said piston and to gradually close each of said discharge conduits during a discharge stage of said piston.

6. The piston-type fluid displacement apparatus of claim 5, wherein said control means controls said driving mechanism and said valve members, such that each of said suction conduits begins to open at said top dead center position of said piston, is opened fully at a position halfway between said top dead center position and said bottom dead center position of said piston, and is closed fully at said bottom dead center position of said piston, and wherein each of said discharge conduits begins to open at said bottom dead center position of said piston, is opened fully at a position halfway between said top dead center position and said bottom dead center position of said piston, and is closed fully at said top dead center position of said piston.

7. The piston-type fluid displacement apparatus of claim 5, wherein said driving mechanism is attached to said drive shaft for rotation therewith.

8. The piston-type fluid displacement apparatus of claim 5, wherein said driving mechanism comprises a cam member having a first connecting means, each of said valve members comprising a second connecting means thereon for joining with said first connecting means of said cam member.

9. The piston-type fluid displacement apparatus of claim 8, wherein said valve member comprises a plate member slidably disposed in said suction conduit and said discharge conduit.

10. The piston-type fluid displacement apparatus of claim 8, wherein each of said valve members comprises a cylindrical member capable of rotating around its longitudinal axis.

11. The piston-type fluid displacement apparatus of claim 10, wherein said cylindrical member has a longitudinal axis perpendicular to an axis of said drive shaft.

12. The piston-type fluid displacement apparatus of claim 8, wherein said first connecting means of said cam member is a groove formed on said cam member, and wherein said second connecting means of said valve members is a projection formed on said valve member.

13. The piston-type fluid displacement apparatus of claim 12, wherein said groove is radially formed on said cam member so as to lie in a zigzag line.

14. The piston-type fluid displacement apparatus of claim 12, wherein said groove is egg-shaped and is axially formed on said cam member.

* * * * *